US006851321B2

(12) United States Patent
Fuchs

(10) Patent No.: US 6,851,321 B2
(45) Date of Patent: Feb. 8, 2005

(54) CONFIGURATION FOR CHECKING THE CLAMPING FORCE OF A COUPLING CONFIGURATION FOR A TRANSPORT ASSEMBLY IN A CABLEWAY SYSTEM

(75) Inventor: Elmar Fuchs, Bregenz (AT)

(73) Assignee: Innova Patent GmbH, Wolfurt (AT)

( * ) Notice: Subject to any disclaimer, the term of this patent is extended or adjusted under 35 U.S.C. 154(b) by 30 days.

(21) Appl. No.: 10/316,433

(22) Filed: Dec. 11, 2002

(65) Prior Publication Data

US 2003/0209081 A1 Nov. 13, 2003

(30) Foreign Application Priority Data

May 10, 2002 (AT) ..... A 727/2002

(51) Int. Cl.[7] ..... G01N 3/02; G01L 1/26; G01L 5/04

(52) U.S. Cl. ..... 73/856; 73/862.39; 73/1

(58) Field of Search ..... 73/862.391, 862.381, 73/862.451, 862.621, 862.625, 862.626, 862.624

(56) References Cited

U.S. PATENT DOCUMENTS 4,255,975 A * 3/1981 Debreuille ..... 73/862.626

6,224,015 B1 * 5/2001 Reinhard ..... 244/24

* cited by examiner

*Primary Examiner*—Edward Lefkowitz
*Assistant Examiner*—T Miller
(74) *Attorney, Agent, or Firm*—Laurence A. Greenberg; Werner H. Stemer; Ralph E. Locher

(57) ABSTRACT

A configuration for checking the clamping force to which the supporting and haulage cable is subjected by the coupling configuration for a transport assembly of a cableway system. The coupling configuration has a clamping lever which is subjected to the action of a spring-energy storage device and on which is mounted an actuating roller which rolls along a running surface of a guide rail. The running surface is formed with an elastically deformable region which is assigned a measuring configuration with which it is possible to measure the deformation of the running surface on account of the compressive force which is produced by the spring-energy storage device, acts on the guide surface via the actuating roller and corresponds to the clamping force. In this case, the measuring configuration is formed by at least two measuring units that function in different ways.

11 Claims, 3 Drawing Sheets

CONFIGURATION FOR CHECKING THE CLAMPING FORCE OF A COUPLING CONFIGURATION FOR A TRANSPORT ASSEMBLY IN A CABLEWAY SYSTEM

BACKGROUND OF THE INVENTION

Field of the Invention

The present invention relates to a configuration for checking the clamping force to which the supporting and haulage cable is subjected by the coupling configuration for a transport assembly of a cableway system. The coupling configuration of this type has a clamping lever which is subjected to the action of a spring-energy storage device and an actuating roller mounted on the clamping lever that rolls along a running surface of a guide rail. The running surface is formed with an elastically deformable region which is assigned a measuring configuration by means of which it is possible to measure the deformation of the running surface on account of the compressive force that is produced by the spring-energy storage device, that acts on the running surface via the actuating roller, and that corresponds to the clamping force.

The prior art has previously known a configuration that is intended for checking the clamping force of a coupling configuration. In that system, the clamping force of the coupling configuration to which the supporting and haulage cable is subjected by the spring-energy storage device is checked by the provision of a second spring-energy storage device by way of which, in the case where the compressive force applied by the first spring-energy storage device is not sufficient, an actuating lever is pivoted. The latter actuates a switch for switching off the cableway system.

That prior art configuration for checking the clamping force, however, gives rise to a very high maintenance outlay.

An electronically acting configuration for checking the clamping force has also become known from the prior art. In the case of this configuration, a region which can be elastically deformed under the action of the compressive force exerted by an actuating roller arranged on a pivotable clamping lever is provided on the running surface of a guide rail for the actuating roller, the region being assigned an electronic measuring unit by means of which it is possible to measure the deformation of this region. Since the extent to which this region of the running surface is deformed is dependent on the magnitude of the compressive force to which the running surface is subjected by the actuating roller, the compressive force, for its part, corresponding to the magnitude of the clamping force to which the supporting and haulage cable is subjected by the coupling configuration, the clamping force can be determined and/or checked by the electronic measuring unit.

Although this known configuration is advantageous in comparison with mechanical clamping-force checking, it does not fulfill the existing requirements since the sought-after functional reliability is not ensured by a single electronic measuring unit. The supposedly obvious solution to this problem, of providing a plurality of electronic measuring units for determining the deformation of the measuring region of the running surface, is not applicable since the electronic measuring units influence one another, as a result of which the necessary functional reliability is not achieved.

SUMMARY OF THE INVENTION

It is accordingly an object of the invention to provide a monitoring configuration for checking a clamping force of a coupling device of a transport assembly in a cableway system which overcomes the above-mentioned disadvantages of the heretofore-known devices and methods of this general type and which checks the clamping force electronically and avoids the disadvantages associated with the prior art configuration.

With the foregoing and other objects in view there is provided, in accordance with the invention, a configuration for checking a clamping force with which a coupling configuration of a transport assembly in a cableway system acts on a supporting and haulage cable. The coupling configuration has a clamping lever and a spring-energy storage device acting on the clamping lever, and an actuating roller mounted on the clamping lever for rolling along a running surface of a guide rail. The running surface of the guide rail is formed with an elastically deformable region, and a measuring configuration is disposed to measure a deformation of the elastically deformable region of the running surface on account of a compressive force produced by the spring-energy storage device, the compressive force acting on the guide surface via the actuating roller and corresponding to the clamping force. In accordance with the invention, the the measuring configuration is formed with at least two measuring units that function in mutually different ways.

In other words, the objects of the invention are achieved in that the measuring configuration is formed by at least two measuring units which function in different ways. Since the measuring units thus do not disrupt one another, the necessary functional reliability is ensured.

The at least two measuring units preferably operate at different oscillator frequencies. It is possible here for the at least two measuring units to be arranged one beside the other in the movement direction of the actuating roller or one behind the other in the movement direction of the actuating roller. Furthermore, it is also possible to provide three measuring units which are arranged one beside the other and/or one behind the other in the movement direction of the actuating roller, as a result of which the functional reliability is yet further increased.

In accordance with a concomitant feature of the invention, the at least two measuring units are formed by inductive transducers or by capacitive transducers, of which the oscillators are designed for different frequencies. Furthermore, the at least two measuring units may be formed by ultrasound units, of which the oscillator frequencies are different. In addition, the at least two measuring units may be formed by light-measuring units which operate at different pulse frequencies. In this case, in each case one of the units is designed as an inductive transducer, as a capacitive transducer, as an ultrasonic generator and/or as a light-measuring unit.

Other features which are considered as characteristic for the invention are set forth in the appended claims.

Although the invention is illustrated and described herein as embodied in a configuration for checking the clamping force of the coupling configuration for a transport assembly of a cableway system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
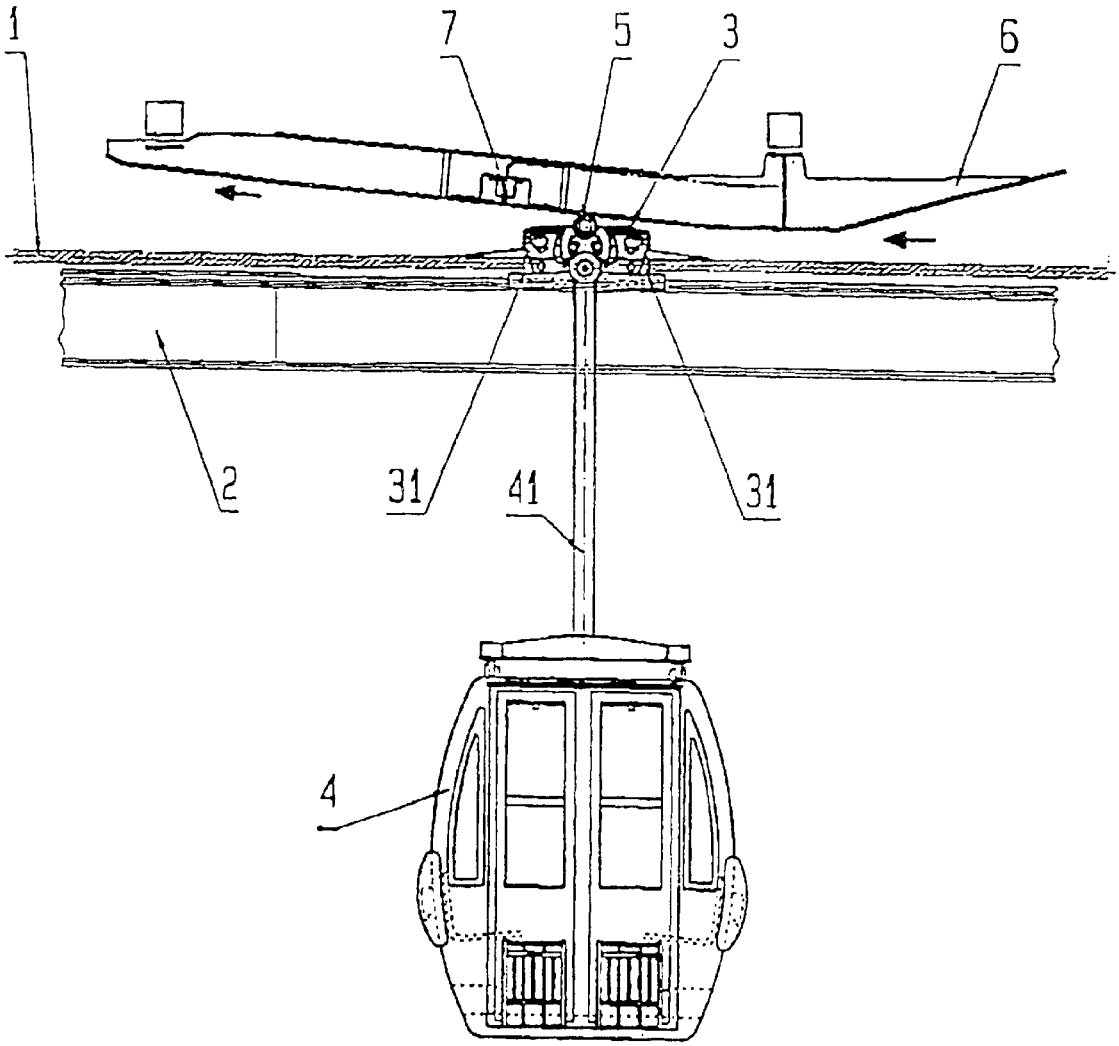
FIG. 1 is a side elevational view of a part of a cableway system with a configuration for checking the clamping force of the coupling assemblies with a measuring configuration according to the invention.

Referring now to the figures of the drawing in detail and first, particularly, to FIG. 1 thereof, there is shown a system for determining the clamping force which is applied by the spring-energy storage device of a coupling configuration and acts on the supporting and haulage cable 1 of a cableway system. The system has a running rail 2 for the running-gear mechanism 3 of a transport assembly 4 arranged on a load-bearing bar 41. Running rollers 31 are provided on the running-gear mechanism 3 which allow the transport assembly 4 to be displaced along the rails 2. The rails 2 are provided in the stations, wherein the transport assembly is uncoupled from the haulage cable. There is also provided on the running-gear mechanism 3 a coupling configuration which allows the transport assembly 4 to be coupled to the supporting and haulage cable 1.

The movable coupling jaw is formed with an actuating lever which is subjected to the action of a spring-energy storage device and which applies the clamping force necessary for the coupling to the supporting and haulage cable 1. An actuating roller 5 is mounted at the free end of the actuating lever. The roller 5 rolls along a control rail 6. A measuring configuration 7 is provided in order to check the clamping force applied by the spring-energy storage device. In the case where the clamping force is not sufficient, the cableway system is switched off by the measuring configuration 7.

Such a system is known from the prior art, except that the invention described herein provides for a novel sensor and monitoring system.

Figure 2:
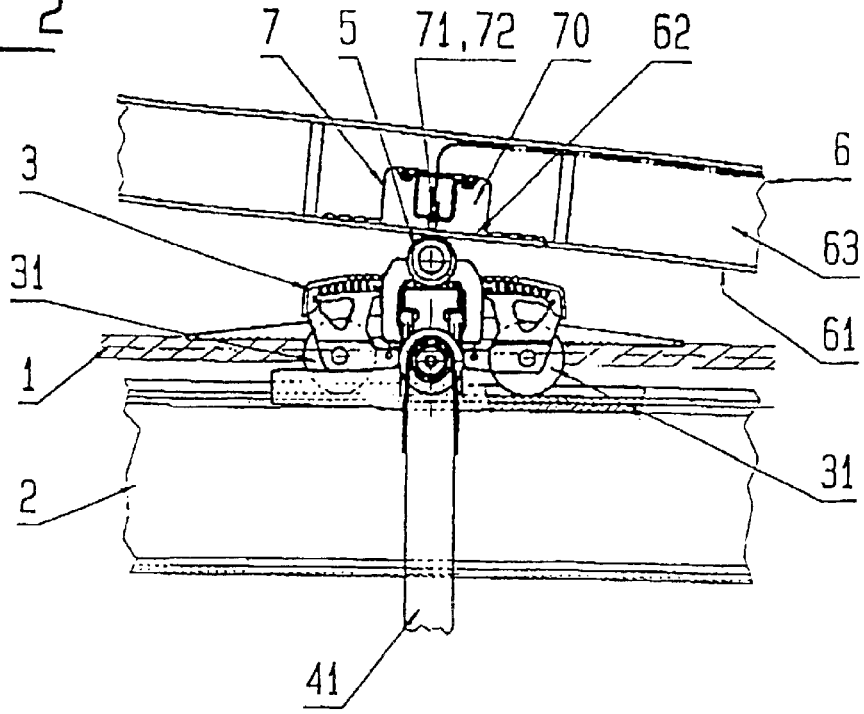
FIG. 2 is an enlarged detail from FIG. 1.

With reference to FIG. 2, the measuring configuration 7 according to the invention provides for a region 62, which can be elastically deformed. The deformable region 62 is provided in the running surface 61 of the control rail 6 for the actuating roller 5 of the coupling lever, the region 62 of the running surface 61 being assigned two measuring units 71, 72. The control rail 6 of the exemplary embodiment is a T-shaped rail, and comprises a web 63 and the running surface 61 arranged thereon. The web 63 is absent in the region of the measuring units 71, 72 and the two measuring units 71,72 are arranged in the resulting cutout 70. In the region 62, the running surface 61, since it is not supported by the web 63, can be deformed under the action of the spring-energy storage device acting on the actuating roller 5. This force action results in the distance between the running surface and the measuring units 71, 72 to change. This change in distance, which constitutes a measure of the compressive force or of the clamping force, can be detected by the electronic measuring units 71, 72, as a result of which it is possible to check the clamping force.

In order to ensure the sought-after functional reliability, it is necessary to provide a plurality of measuring units. It should be ensured, however, that these do not influence one another in functional terms.

Figure 3:
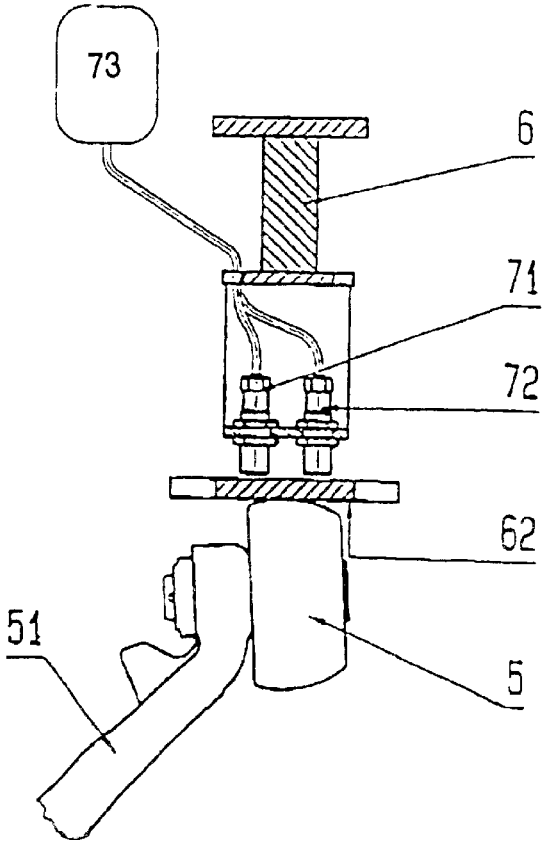
FIG. 3 is a further enlarged view of the measuring configuration shown from a different angle than FIG. 2.
Figure 3A:
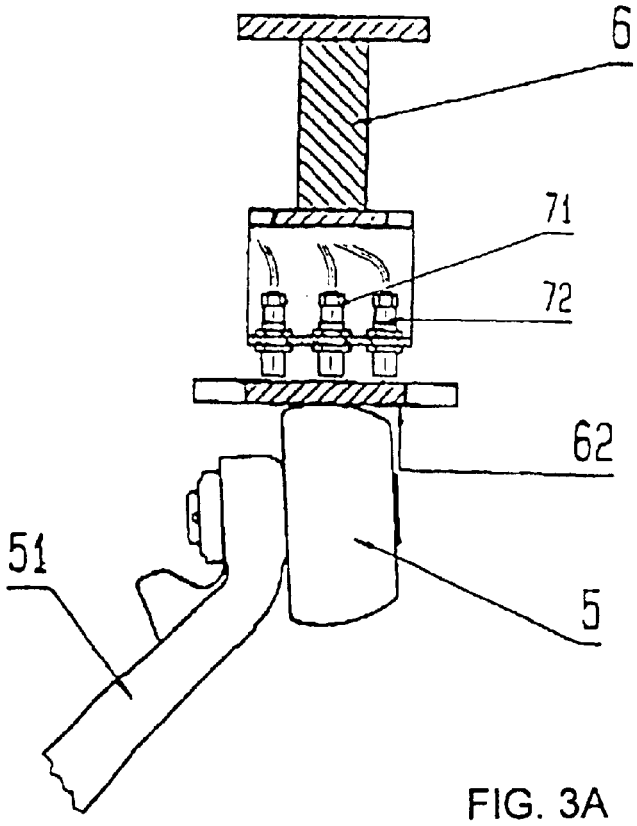
FIG. 3A is a similar view of the configuration with three measurement sensors disposed adjacent one another.
Figure 3B:
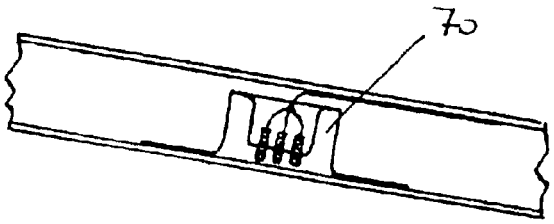
FIG. 3B is a side view illustrating an embodiment with three sensors disposed longitudinally one behind another.
Figure 3C:
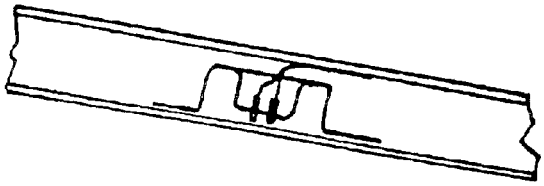
FIG. 3C is a similar view illustrating an embodiment with two sensors disposed longitudinally one behind another.

As can be seen from FIG. 3, two measuring units 71 and 72 are provided, these being arranged one beside the other transversely to the running direction of the actuating roller 5 mounted on the coupling lever 51 and the outputs of the measuring unit being attached to a control unit or control and evaluation circuit 73. In order, nevertheless, to ensure that they function independently of one another, these two electronic measuring units 71 and 72 have to have different oscillator frequencies. In a preferred embodiment, 330 kHz and 360 kHz are used, in particular, as the oscillator frequencies. It is possible here to select the oscillator frequencies within a very wide range. The critical factor is for the frequencies of the measuring units arranged one beside the other to differ, in order thus to prevent the measuring units from influencing one another.

The electronic measuring units may be inductive transducers, capacitive transducers and ultrasonic generators, of which the oscillation frequencies are different in each case. In addition, it is possible to use light-measuring units which are operated at different pulse frequencies. It is possible here to use either the same types of measuring units operated at different frequencies or different types of measuring units, e.g. an inductive transducer and a capacitive transducer.

The measuring units may be arranged one beside the other transversely to the movement direction of the actuating roller 5 or one behind the other in the movement direction of the actuating roller 5. A greater number of measuring units increases the reliability of the measuring result.

The outputs of the measuring units 71 and 72 are connected to the control and evaluation circuit 73. If the evaluation of the measuring results establishes an insufficient clamping force, the cableway system is switched off by the control and evaluation circuit 73.

I claim:

1. In a configuration for checking a clamping force with which a coupling configuration of a transport assembly in a cableway system acts on a supporting and haulage cable thereof, the coupling configuration having a clamping lever and a spring-energy storage device acting on said clamping lever, and an actuating roller mounted on said clamping lever for rolling along a running surface of a guide rail, said running surface of said guide rail being formed with an elastically deformable region, and a measuring configuration disposed to measure a deformation of said elastically deformable region of said running surface on account of a compressive force produced by said spring-energy storage device, the compressive force acting on said guide surface via said actuating roller and corresponding to the clamping force, the improvement which comprises:

at least two measuring units forming said measuring configuration, said at least two measuring units functioning in mutually different ways.

2. The apparatus according to claim 1, wherein said at least two measuring units have mutually different oscillator frequencies.

3. The apparatus according to claim 1, wherein said at least two measuring units are disposed beside one another in a movement direction of the actuating roller.

4. The apparatus according to claim 1, wherein said at least two measuring units are disposed behind one another in a movement direction of the actuating roller.

5. The apparatus according to claim 1, wherein said at least two measuring units are at least three measuring units disposed in locations selected from the group consisting of beside one another and behind one another in a movement direction of the actuating roller.

6. The apparatus according to claim 1, wherein said at least two measuring units include inductive transducers having oscillators with mutually different frequencies.

7. The apparatus according to claim 1, wherein said at least two measuring units include capacitive transducers having oscillators with mutually different frequencies.

8. The apparatus according to claim 1, wherein said at least two measuring units are ultrasound units having mutually different oscillator frequencies.

9. The apparatus according to claim 1, wherein said at least two measuring units are light-measuring units configured to operate at mutually different pulse frequencies.

10. The apparatus according to claim 1, wherein one of said at least two measuring units is selected from the group consisting of an inductive transducer, a capacitive transducer, an ultrasound generator, and a light-measuring unit.

11. In a cableway system having a transport assembly and a coupling configuration for coupling the transport assembly to a supporting and haulage cable, the coupling configuration including a clamping lever subjected to a force action of a spring-energy storage device and an actuating roller mounted thereon for rolling along a running surface of a guide rail, whereby the clamping lever effects a clamping force on the supporting and haulage cable when the transport assembly is coupled to the supporting and haulage cable, a configuration for monitoring the clamping force, comprising:

an elastically deformable region forming a part of the running surface of the guide rail;

a measuring configuration disposed to monitor said running surface and to measure a deformation of said elastically deformable region on account of the force action generated by the spring-energy storage device, acting on said guide surface via said actuating roller, and corresponding to the clamping force on the supporting and haulage cable, said measuring configuration including at least two measuring units with mutually different functionality.

* * * * *